US006199494B1

(12) United States Patent
Griffin

(10) Patent No.: US 6,199,494 B1
(45) Date of Patent: Mar. 13, 2001

(54) METHOD OF IMPROVING THE PERFORMANCE OF A CYCLONE FURNACE FOR DIFFICULT TO BURN MATERIALS, AND IMPROVED CYCLONE FURNACE THEREOF

(76) Inventor: Edwin M. Griffin, 9184 S. Leroy Rd., P.O. Box 240, Westfield, OH (US) 44251

( * ) Notice: Subject to any disclaimer, the term of this patent is extended or adjusted under 35 U.S.C. 154(b) by 0 days.

(21) Appl. No.: 09/365,850

(22) Filed: Aug. 3, 1999

(51) Int. Cl.[7] ..... F23J 11/00; F23C 15/00; F23D 1/02; F23B 5/04

(52) U.S. Cl. ..... 110/348; 110/345; 110/308; 110/302; 110/265; 110/264; 110/214; 110/213; 110/208; 110/211; 110/210; 110/203

(58) Field of Search ..... 110/203, 210, 110/211, 208, 213, 214, 234, 264, 265, 302, 304, 308, 345, 348

(56) References Cited

U.S. PATENT DOCUMENTS 4,850,288 * 7/1989 Hoffert et al. ..... 110/214

FOREIGN PATENT DOCUMENTS

218157A * 1/1985 (DE) ..... 110/263

* cited by examiner

*Primary Examiner*—Denise L. Ferensic
*Assistant Examiner*—K. B. Rinehart
(74) *Attorney, Agent, or Firm*—Foley & Lardner

(57) ABSTRACT

The firing performance of a radial, scroll, or vortex cyclone furnace can be improved when firing difficult to burn materials having a relatively low heating value or a relatively high moisture content, such as sub-bituminous and lignite coals. This can be achieved by introducing additionally heated primary air into the burner of the radial and vortex cyclone furnace or separately introducing preheated or additionally heated auxiliary air into the scroll burner. Moreover, additionally heated tertiary air can be introduced into the radial and scroll burners to further improve firing performance. Moreover, additionally heated primary air can be mixed with the coal before introducing the mixture into the scroll burner to further improve firing performance.

32 Claims, 5 Drawing Sheets

METHOD OF IMPROVING THE PERFORMANCE OF A CYCLONE FURNACE FOR DIFFICULT TO BURN MATERIALS, AND IMPROVED CYCLONE FURNACE THEREOF

BACKGROUND

In the 1940's, Babcock & Wilcox (B&W) developed a cyclone furnace, which uses ash slagging, to burn low-grade coals. At that time, low-grade coals were considered unsuitable for pulverized coal combustion. The cyclone furnace concept was originally designed to 1) lower fuel preparation capital and operating costs by using relatively larger crushed coal particles (¼" or less); 2) combust coal completely or nearly completely in a relatively small cylindrical chamber; 3) lessen flyash and convection pass fouling (as only 15 to 30% of the convecting fuel ash passes instead of 80% for pulverized coal firing) by melting the ash contained in the coal and separating a large percentage of it from the flue gas; and 4) accurately measure and control coal flow and air flow to each burner.

Cyclone furnaces fire relatively large crushed coal particles, approximately 95–97% passing through a 4 mesh screen. Many of these particles are much too large to burn completely in air suspension. To completely combust them, they are thrown against the inner wall of the combustion chamber, where they are captured by a molten slag layer. The combustion air passes over the incompletely burned particles (air scrubbing) stuck in the molten sticky slag layer, which captures and holds the heavier particles. While the large particles are trapped in the slag layer, the fine coal particles burn in suspension, which provides the necessary intense radiant heat supplied to the slag layer. Ideally, it is desirable to trap all large coal particles in the molten slag so that they can completely combust, leaving behind only ash to replenish the slag layer. Compared to a pulverized coal furnace, a cyclone furnace requires a relatively smaller combustion chamber.

Three types of burners have been developed for use with the cyclone furnace: scroll, vortex, and radial. With each of these burners, cyclone furnaces use a horizontally oriented cylindrical barrel (of water-cooled tube construction), typically 6 to 10 ft in diameter, attached to the front and/or rear of a boiler (main) furnace. A cyclone burner is positioned at the frontwall (upstream wall) of the cylindrical barrel, collinearly aligned therewith. Crushed coal and air (primary and tertiary (for scroll and radial burners only)) enter through the cyclone burner where the fuel is ignited. The coal-air fuel mixture is propelled to the combustion chamber where the larger coal particles are captured in the molten slag while the finer particles are burned in suspension in the combustion chamber. Main combustion (secondary) air is introduced into the combustion chamber to impart a swirl to the coal particles. Combusted products leave the cyclone furnace through the re-entrant throat (exhaust outlet). A molten slag layer develops and coats the inner surface of the combustion chamber. The slag drains to the bottom of the cyclone and is discharged through the slag tap. To capture the molten slag, the inside of the combustion chamber is provided with densely populated short pin studs that extend radially inwardly from its inner surface. A refractory lining material (insulation) is embedded in the pin studs to maintain the combustion chamber at a sufficient temperature to permit slag tapping from the bottom of the combustion chamber and significantly reduce the potential for corrosion.

In scroll and radial burner types, crushed coal is introduced tangentially to the inner wall of the cyclone burner to impart a swirl to the crushed coal. A vortex burner, on the other hand, introduces crushed coal from the burner end wall. Primary air is also introduced tangentially into the burner to further impart a swirl to the crushed coal in vortex and radial burners. In the scroll burner, primary air and crushed coal are premixed before they are introduced into the burner. The scroll and radial burners also use tertiary air to control axial flame displacement and to prevent coal from continuously recirculating at the burner end wall. In all three types, secondary (main combustion) air is introduced tangentially to the cyclone barrel in the same rotation direction as the coal swirling motion imparted by primary air to further impart a swirl to the coal. Primary air, secondary air, and tertiary air are typically tapped from a windbox (air duct), which supplies preheated air. The preheated air in the windbox is obtained by passing ambient air through a heat exchanger, which derives heat from the gases exhausting from the boiler to which the cyclone furnace is attached. Typically, the heat exchanger heats air to about between 550–600° F.

The purpose of cyclone primary air is to distribute coal into the combustion chamber. Primary air enters the burner tangential to the cylindrical inner wall to impart a swirl to the crushed coal introduced into the burner or carry the crushed coal (in scroll burner) into the cyclone burner with a swirl. Primary air controls the coal distribution within the combustion chamber. Generally, primary air is about 10–20% of combustion air flow.

Secondary (main combustion) air is injected tangentially to create a swirling motion in the combustion chamber in the same direction as the swirl imparted by primary air. The swirling motion throws the large coal particles against the inside surface of the combustion chamber, where they are trapped in the slag layer and burn to completion. Secondary air is about 85% of the combustion air supplied to each cyclone.

Tertiary air enters the center of the burner along the cyclone axis, directly into the cyclone vortex. The purpose of cyclone tertiary air (for radial and scroll type cyclones) is to minimize coal recirculation at the "eye" of the burner. Generally, tertiary air is about 3% of combustion air flow.

Early cyclone furnaces were of the scroll type, which combines primary air and coal before entering the burner. Tertiary air is admitted at the center of the burner to minimize coal recirculation at the eye of the burner. In vortex cyclone furnaces, primary air is injected into the cyclone burner tangentially as with the scroll type, but the coal is introduced at the burner center. This configuration eliminated the tertiary air requirement. The radial burner concept was developed in the 1960s to solve the wear-block erosion problem. Like the vortex burner, coal and primary air are separately introduced into the radial burner. Coal is introduced tangentially in the same rotation as the primary air. The coal particles form a long rope (concentrated stream of coal) as it sweeps across the burner wear blocks and enter the cyclone barrel. This approach greatly reduced the concentration of coal recirculating around the burner, effectively reducing wear-block erosion. Tertiary air was introduced using the same axial entry location as with the scroll burner.

Modern cyclone furnaces incorporate radial burners to combust bituminous and sub-bituminous coals and scroll burners to combust lignite coal. The scroll burner is used to combust lignite coal because, with lignite firing, the primary air is mixed with coal during coal preparation, before introducing coal into the burner. When mixed with coal, primary air can heat coal to about 150–250° F. (the mixture temperature). Due to evaporation of moisture in the coal, the temperature stays in this range even if the primary air temperature is raised, e.g., to 700° F.

When operating properly, cyclone furnaces generate much greater heat than the water-cooled walls can absorb. The combined high heat release and low heat absorption rates ensure the high temperatures needed to nearly complete the combustion within the cyclone furnace and maintain the slag layer in a molten state. The intense radiant heat and high temperatures melt the ash into a liquid slag coating, which covers the entire cyclone interior surface except for the area immediately in front of the secondary air inlet. The refractory lining further assists this molten condition by limiting heat absorption to the water-cooled walls. The slag flows constantly from the cyclone into the main furnace where it drains through a floor tap opening into a water-filled tank.

Fuel suitability for cyclone furnaces depends on many characteristics of the fuel, such as heating value, ash content, moisture content, ash fusion temperatures, and viscosity of the fuel ash at the cyclone operating temperature. The most important consideration in cyclone firing is that the temperature in the cyclone furnace must be high enough to maintain a molten slag coating and cause the ash to flow continuously from the cyclone furnace.

This consideration was easily met for a wide spectrum of bituminous coals in the U.S. Currently, a significant portion of electric power generation in the U.S. is by units having cyclone furnaces.

To meet $SO_x$ emission requirement and to minimize fuel cost, it is highly desirable to burn sub-bituminous coal, which typically has a very low sulfur content and is relatively inexpensive. As a result, a large number of cyclone furnace units, designed to burn bituminous coal have been converted to burn sub-bituminous coal or a blend of mostly sub-bituminous coal. Sub-bituminous coal, however, is difficult to burn satisfactorily in most cyclone burners designed to burn bituminous coal because, due to the higher moisture content of the sub-bituminous coal, the cyclone temperature often is too low for the ash to continuously flow from the cyclone furnace. The cyclone furnace temperature is lower when burning sub-bituminous coal because of the necessity to evaporate the high moisture content of sub-bituminous coal and because the high moisture content delays combustion and thus reduces the percentage of combustion that occurs within the cyclone furnace. As a consequence, most cyclone furnace boilers that have been switched to sub-bituminous coal have to burn a blend of sub-bituminous coal with an expensive high heat value "kicker" coal or accept lower boiler efficiency due to increased discharge of unburned coal. The industry thus has been searching for economical ways to enable burning sub-bituminous coals, without blending them with more expensive bituminous or higher heating value "kicker" coals, as much economical advantage can be gained therefrom.

Thus, there is a need for a more economical way to burn higher percentages of low-grade fuel in cyclone furnaces. The present inventor has a found a more economical way to burn low-grade solid fuel, particularly sub-bituminous and lignite coals in cyclone furnaces.

The above background information is derived from my personal experience and observations, and from Babock & Wilcox's publication, *STEAM,* 40th Edition, Chapter 14, Cyclones, the disclosure of which is incorporated herein by reference as a general background information.

SUMMARY

The present invention relates to a method and apparatus for improving the performance of a cyclone furnace having a radial, scroll, or vortex burner when firing difficult to bum materials having a relatively low heating value or a relatively high moisture content, such as sub-bituminous and lignite coals, by introducing additionally heated primary air into the radial and vortex burners, or separately introducing preheated or additionally heated auxiliary air into the scroll burner. Moreover, additionally heated tertiary air can be introduced into the radial and scroll burners to further improve performance. Moreover, additionally heated primary air can be mixed with the coal before introducing the mixture into the scroll burner.

The "burner" hereafter generically means the radial, scroll, or vortex burner, unless specifically defined otherwise.

The cyclone furnace typically includes a barrel having a tubular wall with an upstream wall and a downstream wall. The tubular wall, the upstream wall, and the downstream wall define a combustion chamber. The upstream wall has an inlet that introduces a combined crushed solid fuel and air into the combustion chamber, and the downstream wall has an exhaust outlet or re-entrant throat that exhausts combusted products. The barrel tubular wall has a secondary air inlet that introduces, substantially tangentially to the barrel tubular wall to impart a swirl in the barrel, secondary (main combustion) air that has been preheated to the preheat temperature. A secondary air duct can convey preheated secondary air to the second inlet.

The cyclone furnace is typically used in conjunction with a boiler, which has a heat exchanger located downstream of the boiler to preheat air. Air preheated by the heat exchanger is a preheat air source. A windbox or air duct supplies air to the combustion chamber and the burner. The heat exchanger derives heat from hot gases exhausting from the boiler and heats air conveyed to the windbox.

The burner extends axially outwardly from the upstream wall, away from the barrel. The burner has a cylindrical wall aligned with the upstream wall inlet, and an endwall closing an outer end of the burner cylindrical wall opposite the upstream wall inlet.

The radial and the vortex burners have a primary air inlet through the burner cylindrical wall that introduces, substantially tangentially to the burner cylindrical wall to impart a swirl, primary air that has been preheated to a preheat temperature, which is substantially above an ambient temperature. The radial and vortex burners have a fuel inlet that introduces the crushed solid fuel. In the radial burner, the crushed solid fuel is introduced through the fuel inlet substantially tangentially to the burner cylindrical wall to impart a swirl in the same direction as the swirl imparted by primary air. In the vortex burner, the crushed solid fuel is introduced through the burner end wall where the fuel inlet is located. A primary air duct supplies primary air from the windbox through an auxiliary heater.

The radial burner further includes a tertiary air inlet that introduces tertiary air to the burner end wall.

The scroll burner has a fuel inlet through the burner cylindrical wall that introduces, substantially tangentially to the burner cylindrical wall to impart a swirl, primary air that also has been preheated to a preheat temperature, which is substantially above an ambient temperature, mixed with the crushed solid fuel. The scroll burner also has a tertiary air inlet at the burner endwall to introduce tertiary air substantially axially toward the upstream wall inlet. The scroll burner has a fuel duct that conveys a mixture of preheated primary air from the windbox or air supply duct and the crushed solid fuel to the fuel inlet. The scroll burner also has an auxiliary air duct that separately conveys preheated or further heated auxiliary air to the burner, and a tertiary air duct that carries tertiary air to the fourth inlet. Auxiliary air can be obtained from preheated primary or secondary air. Moreover, an auxiliary air heater can be used to additionally heat preheated auxiliary air carried by the auxiliary air duct before it is introduced into the scroll burner.

According to one embodiment of the scroll burner, auxiliary air is separately introduced into the scroll burner through the fuel inlet. The first inlet can have a divider partitioning the fuel inlet into a crushed fuel/primary air passage that introduces the mixture of crushed fuel/primary air into the scroll burner and an auxiliary passage that separately introduces the auxiliary air into the burner so that the crushed fuel and primary air mixture and the auxiliary air do not mix until the crushed fuel and primary air mixture and the auxiliary air are substantially introduced into the burner. The divider can be pivotally mounted to the fuel inlet so that the divider is pivotal between a first position where the divider closes the auxiliary passage and a second position where the divider fully opens the auxiliary passage.

According to another embodiment, the scroll burner has an auxiliary air inlet adjacent to the fuel/primary air passage, auxiliary air being introduced into the scroll burner through the auxiliary air inlet.

In the radial and vortex burners, preheated primary air is further heated to a temperature higher than the preheat temperature to cause rapid ignition and thus more nearly complete combustion within the cyclone furnace when burning difficult to burn materials having a relatively low heating value or a relatively high moisture content or both. The additionally heated primary air is conveyed into the primary air inlet, preheated secondary air into the secondary air inlet, and the crushed solid fuel into the fuel inlet. In the radial burner, either preheated or further heated tertiary air is introduced into the tertiary air inlet. Tertiary air can be tapped from the first duct carrying the heated primary air to the primary air inlet.

In the radial and vortex burners, primary air entering the first inlet is heated to a temperature higher than the preheat temperature using a heater, without increasing the temperature of secondary air entering the secondary air inlet. Primary air entering the first inlet is heated to a temperature of at least 50° F. higher than the preheat temperature. Air passing through the heat exchanger is about between 450–650° F. The auxiliary heater is capable of heating preheated primary air to about between 650–950° F.

In the scroll burner, the crushed solid fuel mixed with preheated primary air are introduced into the fuel inlet, preheated secondary air is introduced into the secondary inlet, and auxiliary air having a temperature substantially equal to or higher than the preheat temperature are separately introduced into the scroll burner to cause rapid ignition and thus more nearly complete combustion when burning difficult to burn materials having a relatively low heating value or a relatively high moisture content.

Preheated auxiliary air introduced into the auxiliary air inlet can be heated to a temperature higher than the preheat temperature using an auxiliary heater, without increasing the temperature of the primary air mixed with the crushed solid fuel entering the fuel inlet and the secondary air entering the secondary air inlet. The auxiliary heater heats preheated auxiliary air entering the scroll burner by at least 50° F. higher than the preheat temperature. The air passing through the heat exchanger is heated to about between 450–750° F. The auxiliary heater is capable of heating preheated auxiliary air to about between 650–950° F.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION

FIGS. 1–4A illustrate various embodiments of cyclone furnaces according to the present invention. The present cyclone furnace comprises any conventional scroll, radial, and vortex cyclone furnace, and an auxiliary heater or an auxiliary duct or both that introduces primary or auxiliary air into the burner at a temperature higher than the temperature of secondary air introduced into the combustion chamber (in radial and vortex cyclone furnaces) or at least the temperature of the secondary air introduced into the combustion chamber (in scroll cyclone furnace).

In a vortex or radial burner, only primary air introduced into the burner needs to be heated using an auxiliary heater or any other heating means to a temperature higher than the preheated air delivered by a windbox, without affecting the temperature of secondary (main combustion) air introduced into the cyclone combustion chamber. As a result, primary air introduced into the burner is at a higher temperature than that of secondary air. In a scroll burner, either a separate inlet is formed in the burner or the inlet for the combined primary air and coal or other solid fuel is provided with a divider so that auxiliary air can be separately introduced into the burner. In the scroll cyclone furnace, a heater is optional, as auxiliary air can be tapped from the windbox or air duct carrying secondary air, if the temperature of secondary air is sufficiently high, such as greater than 600° F. In a radial burner, tertiary air can be tapped from the duct carrying the heated primary air or secondary air or from the windbox. In a scroll burner, tertiary air can be tapped from the duct carrying air from the optional auxiliary heater.

Figure 1:
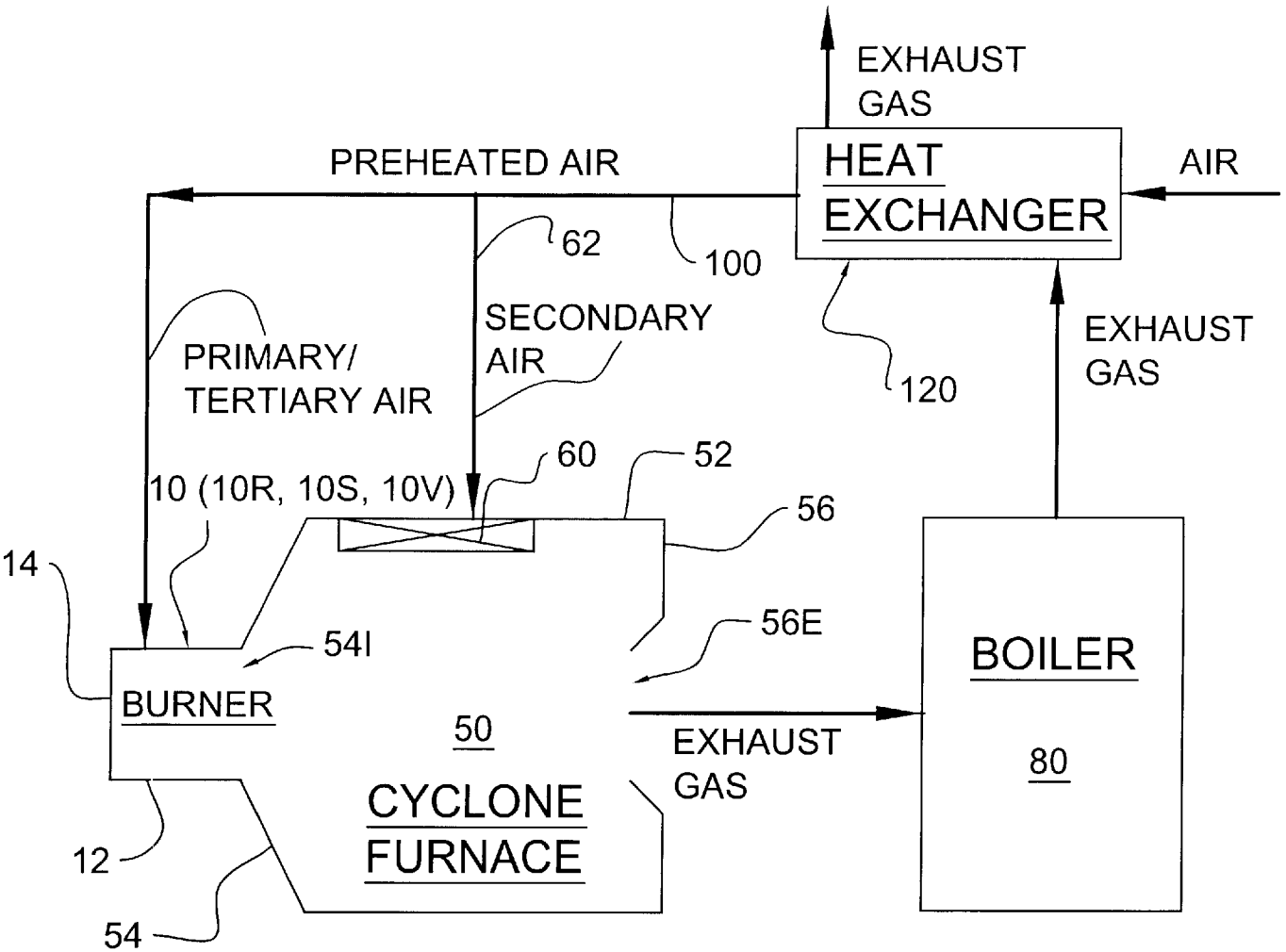
FIG. 1 is a schematic view of a cyclone furnace according to the present invention.

Referring to FIG. 1, a cyclone furnace 1 (whether radial, scroll, or vortex type) has a combustion chamber 50 and a burner 10, which generically designates a radial burner 10R, a scroll burner 10S, and a vortex burner 10V. The combustion chamber 50 comprises a barrel or barrel shaped member defined by a tubular wall 52 with an upstream wall 54 and a downstream wall 56. The tubular wall 52, the upstream wall 54, and the downstream wall 56 define the combustion chamber 50. The upstream wall 54 has an inlet 54I for introducing a combined crushed solid fuel and air into the combustion chamber 50 and the downstream wall has an exhaust outlet or re-entrant throat 56E for exhausting combusted products. The barrel (walls 52, 54, 56) is typically constructed of water-cooled tubular pipes. The combustion chamber has a secondary air inlet 60, which is connected to a secondary air duct 62 that delivers main combustion (secondary) air from a windbox or supply air duct 100. A heat exchanger 120 can be connected to the windbox so that air is introduced through the heat exchanger before it is distributed as primary, secondary, or tertiary air. The heat exchanger 120 preheats air to a preheat temperature in the range of 500–650° F. for vortex and radial cyclone furnaces and 500–750° F. for a scroll cyclone furnace using heat from hot gases exhausting from the boiler. The combustion chamber per se and the boiler/windbox/heat exchanger configuration per se are conventional and well known in the industry.

The burner 10 extends axially outwardly from the upstream wall 54, away from the barrel. The burner 10 has a cylindrical wall 12 aligned with the upstream wall inlet 541, and an endwall 14 closing an outer end of the burner cylindrical wall 12, opposite the upstream wall inlet 54I. The general configuration of a burner per se just described is also conventional and well known.

Figures 3, 3A:
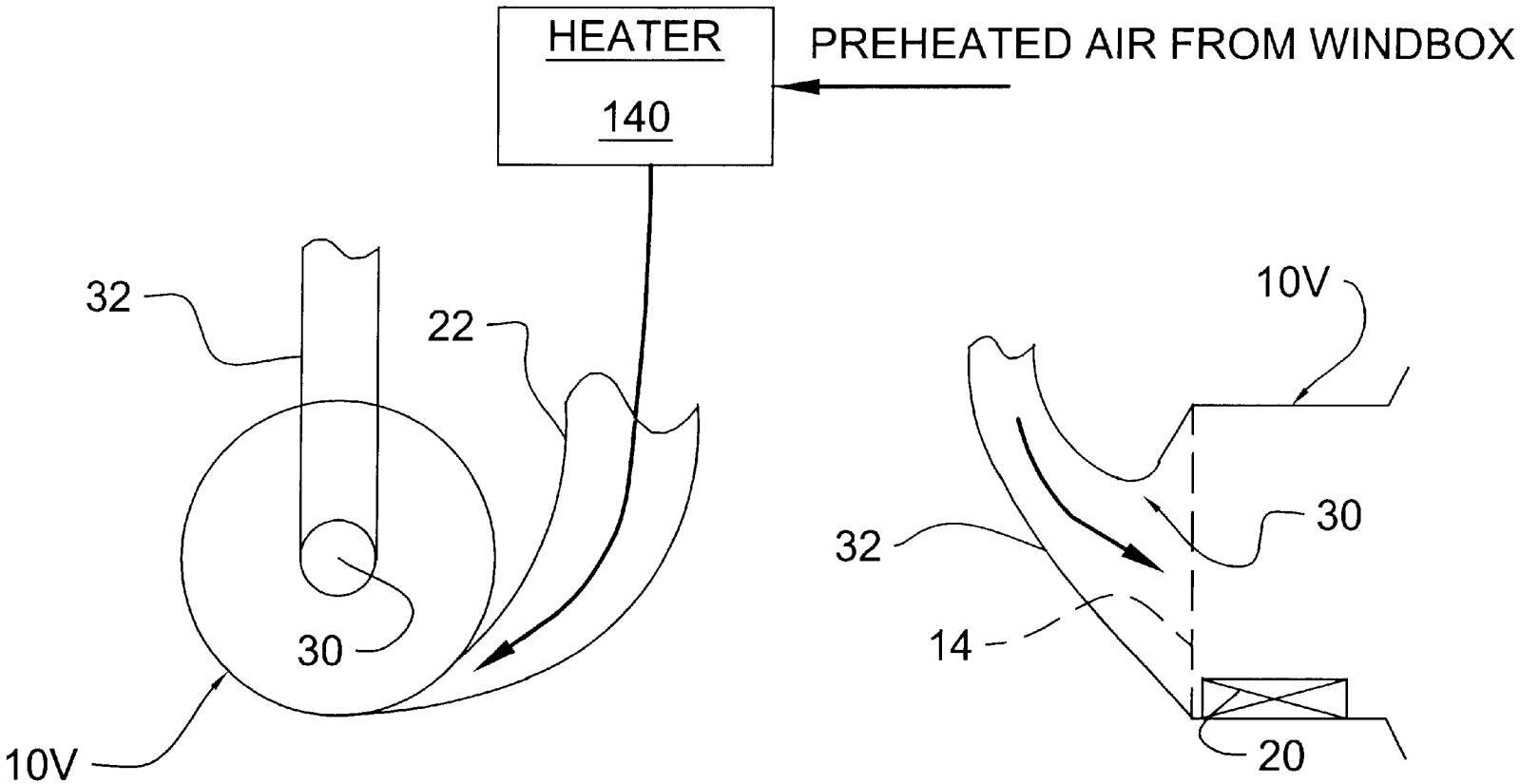
FIG. 3 is a schematic end view of a vortex burner of a cyclone furnace.
FIG. 3A is a schematic side view of the vortex burner of FIG. 3.

FIGS. 3 and 3A illustrate an embodiment of a vortex cyclone furnace according to the present invention. The present vortex cyclone furnace includes the aforedescribed combustion chamber 50, the windbox 100, including the secondary air duct 62, and the heat exchanger 120. The vortex cyclone furnace further includes a vortex burner 10V and an auxiliary heater or duct burner 140. The vortex burner 10V has a primary air inlet 20 that introduces, substantially tangentially to the cylindrical wall 12 to impart a swirl, primary air from the windbox 100. A primary air duct 22 is connected to the windbox 100 and the primary air inlet 20 to convey primary air into the burner 10V.

The auxiliary heater 140, which can be of any conventional heating source, such as gas, electricity, oil, capable of heating preheated primary air from the windbox to a temperature of 650–950° F., is connected to or is in the path of the secondary air duct 22. The heater 140 can be selectively turned on or off, depending on the fuel, and heats only the preheated primary air entering the primary air inlet 20 to a temperature higher than the preheat temperature to promote effective burning of difficult to bum materials having a relatively low heating value or a relatively high moisture content, such as sub-bituminous coal, which beneficially has a low-sulfur content. The secondary air duct 62 conveys preheated secondary (main combustion) air from the windbox 100 to the secondary air inlet 60. The burner 10V has a fuel inlet 30 connected to a fuel duct 32 that introduces crushed solid fuel into the burner from the burner endwall 14. The fuel duct 32 is connected to a fuel supply or source (not shown).

Figures 4, 4A:
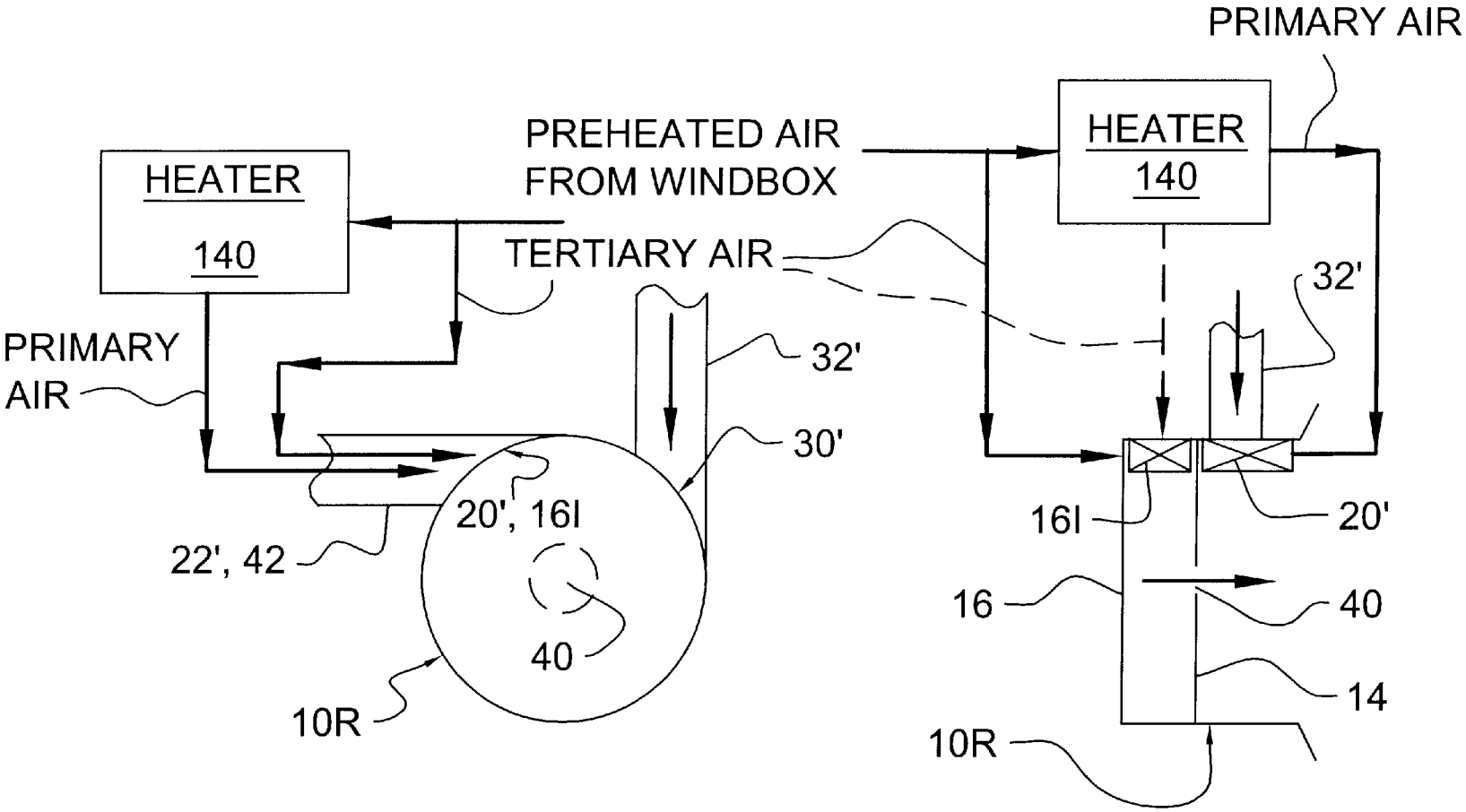
FIG. 4 is a schematic end view of the radial burner of a cyclone furnace.
FIG. 4A is a schematic side view of the radial burner of FIG. 4.

FIGS. 4 and 4A illustrate an embodiment of a radial cyclone furnace according to the present invention. The present radial cyclone furnace also includes the aforedescribed combustion chamber 50, the windbox 100, including the secondary air duct 62, and the heat exchanger 120. The radial cyclone furnace further includes a radial burner 10R and the aforedescribed auxiliary heater 140. The radial burner 10R has a primary air inlet 20° that introduces, substantially tangentially to the cylindrical wall 12 to impart a swirl, primary air from the windbox 100. A primary air duct 22' is connected to the windbox 100 and the first inlet 20' to convey primary air to the burner 10R. The auxiliary heater 140 is connected to or is in the path of the primary air duct 22' and selectively heats only the preheated primary air entering the primary air inlet 20' to a temperature higher than the preheat temperature. This promotes effective burning of difficult to burn materials having a relatively low heating value or a relatively high moisture content, such as sub-bituminous coal. (The secondary air duct 62 conveys preheated secondary (main combustion) air from the windbox 100 to the secondary air inlet 60.) The burner 10R has a fuel inlet 30' connected to a third duct 32' that introduces crushed solid fuel into the burner. The fuel inlet 30' introduces, substantially tangentially to the cylindrical wall 12 to impart a swirl, crushed solid fuel in the same direction as that of primary air. The fuel duct 32' is connected to a fuel supply or source (not shown).

The radial burner 10R also includes a tertiary air inlet 40 that introduces tertiary air to the burner end wall 14. The burner end wall 14 has a central opening (tertiary air inlet) 40 through which tertiary air is directed axially toward the upstream wall inlet 54I. The tertiary air can be fed tangentially through an inlet 16 formed in an end wall housing 16 that encloses the tertiary air inlet 40. The tertiary inlet 40 is connected to a fourth duct 42 that conveys preheated tertiary air from the windbox 100 or secondary duct 62 or primary air duct 22'. As shown in FIG. 4A, tertiary air can be tapped from the portion of the primary air duct 22' that carries primary air heated by the heater 140.

Figure 2A:
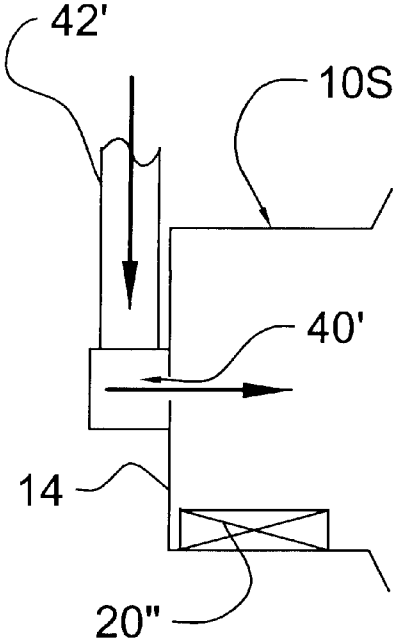
FIG. 2A is a schematic side view of the scroll burner of FIG. 2.
Figure 2:
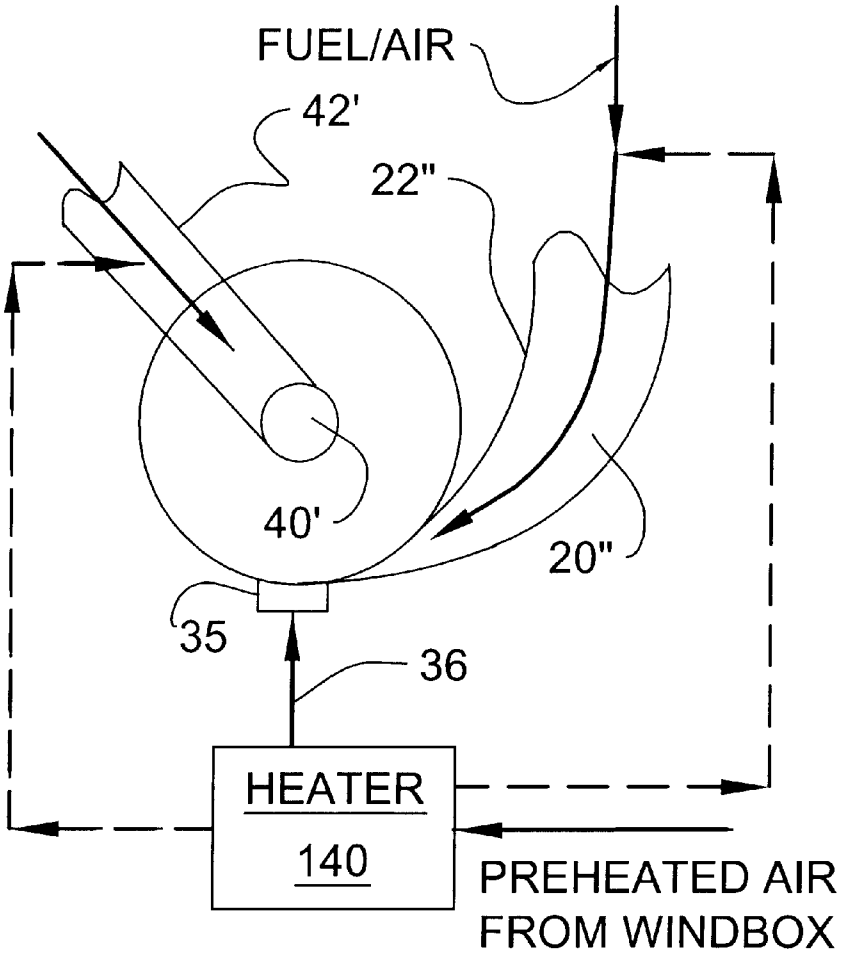
FIG. 2 is a schematic end view of a scroll burner of a cyclone furnace.

FIGS. 2 and 2A illustrate an embodiment of scroll cyclone furnace according to the present invention. The present scroll cyclone furnace also includes the aforedescribed combustion chamber 50, the windbox 100, including the secondary air duct 62, and the heat exchanger 120. The scroll cyclone furnace further includes a scroll burner 10S and can optionally include the aforedescribed auxiliary heater 140. The scroll burner 10S has a fuel inlet 20" that introduces, substantially tangentially to the cylindrical wall 12 to impart a swirl, primary air mixed with crushed solid fuel. A fuel duct 22" is connected to a fuel supply (not shown). Primary air from the windbox 100 is mixed with crushed fuel, such as lignite or sub-bituminous coal and the mixture conveyed to the fuel duct 22." The scroll burner 10S further has a an auxiliary air duct 36 conveys preheated auxiliary air into the burner 10S. The auxiliary air duct 36 is connected to the windbox 100.

In one embodiment of the scroll cyclone furnace, as shown in FIG. 2, the cylindrical wall 12 has a third inlet 35 formed immediately adjacent to the fuel inlet 20" so that preheated auxiliary air is immediately mixed with the mixture when they are introduced into the furnace. As previously explained, mixing preheated air and crushed coal can only achieve a mixture temperature of 150–250° F. Although this can improve performance due to moisture evaporation from the coal, by introducing preheated auxiliary air at a much higher temperature than the mixture temperature, better combustion performance can be achieved, particularly for lignite coal. Moreover, the aforedescribed auxiliary heater 140 can be optionally included in the path of the auxiliary duct 36 to heat auxiliary air higher than the preheat temperature attainable from the windbox 100, and can be included in the path of the primary air carrying duct (not shown) to heat primary or auxiliary air, or both.

Figure 2B:
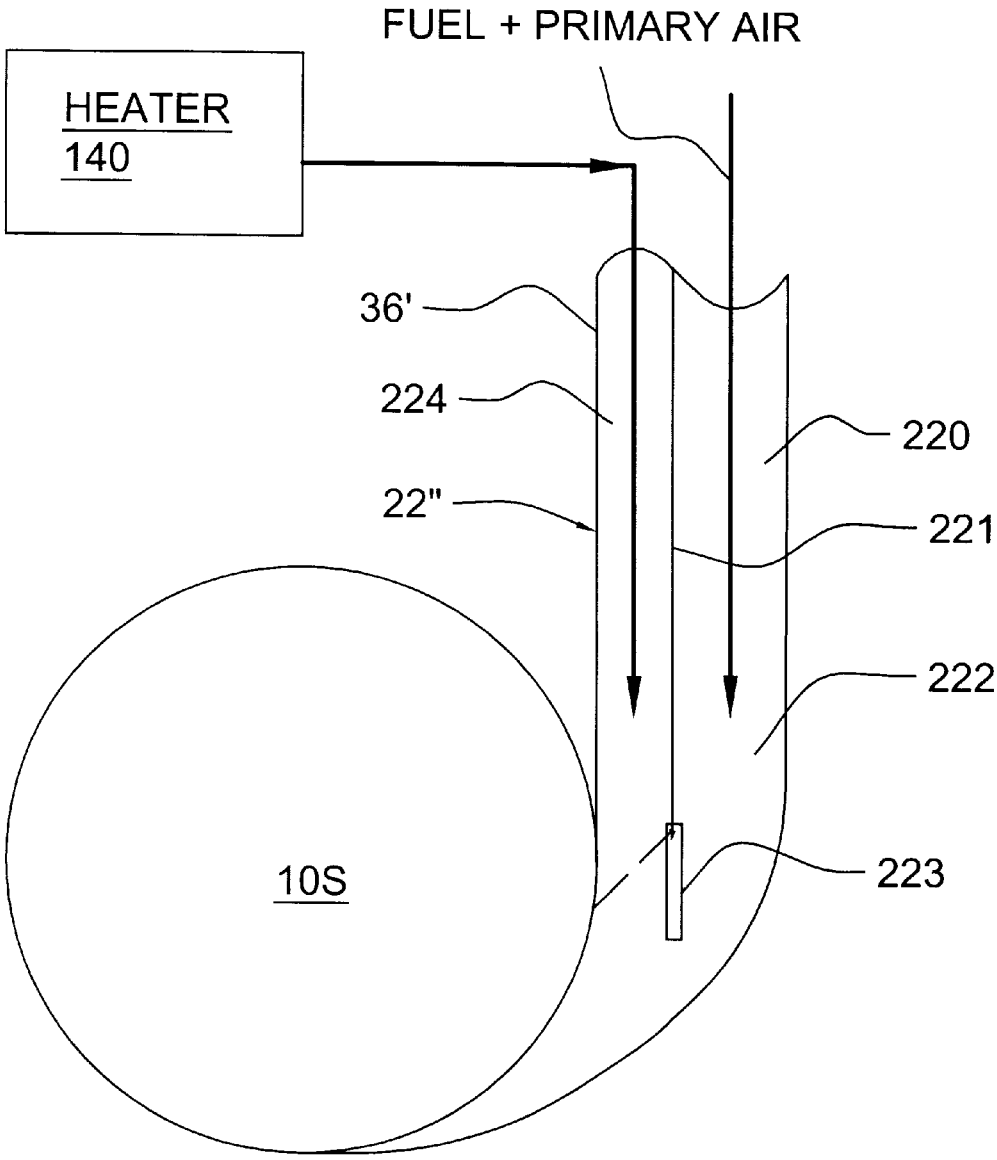
FIG. 2B is a detailed schematic end view of another embodiment of the scroll burner.

In another embodiment, as shown in FIG. 2B, the fuel duct 22" is partitioned with a divider 221 into an auxiliary air passage 224, forming an auxiliary air duct 36', and a fuel passage 222, forming a fuel duct 220. The crushed fuel passage 222 introduces crushed fuel mixed with primary air into the burner. The auxiliary air duct 36' separately conveys preheated auxiliary air into the burner. A flap 223 can be pivotally mounted to the fuel duct 22' so that the flap 223 is selectively pivotal between a first position (as shown in phantom) where it closes the auxiliary air 224 passage and a second position (as shown in solid lines) where it fully opens the auxiliary passage. A motor drive can be used to selectively pivot the flap 223, or can be manually pivoted. The heater 140 can be optionally included in the path of auxiliary air passage 224 to heat the auxiliary air higher than the preheat temperature attainable from the windbox 100.

The auxiliary heater 140 can selectively heat the auxiliary air entering the auxiliary passage 224 or the auxiliary air inlet 35, or primary air or all to a temperature higher than the preheat temperature to promote effective burning of difficult to burn materials having a relatively low heating value or a relatively high moisture content, such as sub-bituminous and lignite coals. Again, the secondary air duct 62 conveys preheated secondary (main combustion) air from the windbox 100 to the secondary air inlet 60. The burner 10S also includes a tertiary air inlet 40' that introduces tertiary air from the burner end wall 14. The end wall 14 has a central opening that introduces tertiary air substantially axially toward the upstream wall inlet 54I. The tertiary air inlet 40' is connected to a fourth duct 42' that conveys preheated tertiary air from the windbox 100 or secondary secondary air duct 62 or primary air duct (not shown). Also, similar to the embodiment of FIG. 4A, tertiary air can be tapped from the portion of the auxiliary air duct 36' that carries air heated by the heater 140 (if used). Thus, primary, auxiliary, and tertiary air can be heated with the heater 140.

Air temperature plays a critical role in achieving a full combustion, particularly for low-grade coals. Ideally, at least primary and secondary air should be introduced into the burner and combustion chamber at about 650–700° F. (at full load) for sub-bituminous coal and at about 700–800° F. (at full load) for lignite coal. Most existing boilers, however, produce windbox air temperatures (at full load) of only between 550–600° F. An increase of 100° F. in combustion air temperature will increase adiabatic combustion temperature 60–70° F. Transferring more heat to the heat exchanger to increase the windbox air temperature reduces the boiler efficiency and introduces other complications. Using auxiliary heaters to additionally heat the air in the windbox consumes much too much energy.

I have discovered that low-grade coals can be successfully fired in conventional cyclone furnaces, which are originally designed for burning higher-grade coals, e.g., bituminous, by merely increasing the temperature of primary air (or primary/tertiary air), which account for about 10–20% of the total combustion air. In the scroll cyclone furnace, an auxiliary air tapped from the windbox or secondary air duct can be additionally introduced into the burner, and may be additionally heated. Since the bulk of the combustion air, namely secondary air, which account for about 80–90%, need not be heated, energy consumption is minimal, while enhancing combustion for the low-grade coals.

To test my theory that only primary/tertiary/auxiliary air needs to be heated between 650–950° F., to satisfactorily burn sub-bituminous coal in conventional cyclone furnaces, a comparative test has been made using conventional cyclone furnace, Units 3-1 and 4-7 at Edgewater Station of Alliant Power Co. in Sheboygan Wis. These Units were designed to fire medium to high sulfur bituminous coals. The Unit 3-1 is one of three scroll type cyclone furnaces for a power generating boiler rated at about 75 megawatts, gross. The Unit 4-7 is one of seven radial type cyclone furnaces for a power generating boiler rated at about 325 megawatts, gross. A gas (propane) operated duct burner 140 was installed in the primary air supply ducts on each of Units 3-1 and 4-7. The duct burners 140 are capable of heating primary/auxiliary/tertiary air from a nominal value of 585° F. (at full load) to about 750–850° F.

For testing, Units 3-1 and 4-7 were fueled with 100% Powder River Basin (PRB) coal from the Black Thunder mine (with the customary 3% tire rubber), while the remaining cyclone furnaces were fueled with a blend of 90% Black Thunder/10% Soshone coal (with the customary 3% tire rubber). Black Thunder coal is a sub-bituminous coal with an average moisture content of about 27.5% and an average heat content of about 8750 BTU/LB. Soshone coal is a bituminous coal with an average moisture content of about 14.2% and an average heat content of about 10840 BTU/LB. For satisfactory operation of the cyclone furnaces at Edgewater Station, when burning PRB coal, such as Black Thunder, without the use of duct burners that add additional heat to the primary air, it has been found necessary to use about 10% Shoshone or other high heat value coal as "kicker" coal. While firing 100% Black Thunder coal in the Units 3-1 and 4-7, the duct burners were adjusted to heat primary air to 750–800°.

Cyclone furnaces on Unit 3 have scroll type burners. Cyclone Unit 3-1 was selected to test the effectiveness of the duct burner because this unit was more troublesome to fire high percentages of PRB coal than other cyclones, namely Unit 3-2 and Unit 3-3. I believe that this is attributed to the cyclone Unit 3-1 operating with a lower secondary air temperature. Initially, a duct burner was arranged to heat only primary air. This improved performance of the cyclone associated with the duct burner. The performance of that cyclone further improved when the duct burner heated primary air, tertiary air, and some auxiliary air, introduced into the burner adjacent to the primary air coal inlet.

To evaluate performance over a long term period, cyclone Unit 3-1 burned 100% Black Thunder coal (with the customary 3% tire rubber), while the other cyclones, Unit 3-2 and Unit 3-3 burned a mixture of 90% Black Thunder and 10% Soshone coal (with the customary 3% tire rubber). During this period of testing, with the duct burner heating primary air, tertiary air, and some auxiliary air introduced into the burner adjacent to the primary air/coal inlet, the performance of Unit 3-1 was as good as the Unit 3-2 and Unit 3-3 burning 90% Black Thunder/10% Soshone coal. Typical performance during this period is shown below in Table 1.

TABLE 1

| Unit | Coal Blend (% Black Thunder/ % Soshone) | Secondary Air Temp. (° F.) | Duct Burner Outlet Temp. (° F.) | Performance (Good, OK, Bad) |
|---|---|---|---|---|
| 3-1 | 100/0 | 590 | 750 | OK |
| 3-2 | 90/10 | 600 | N/A | OK |
| 3-3 | 90/10 | 620 | N/A | OK |

Cyclone furnaces on Unit 4 have radial type burners. Cyclone Unit 4-7 was selected to test the effectiveness of the duct burner because this unit, along with Unit 4-1, was more troublesome when firing high percentages of PRB coal than other cyclones of Unit 4, namely Unit 4-2–Unit 4-6. I believe that this is attributed to the cyclone Unit 4-7 and Unit 4-1 operating with a lower secondary air temperature.

To evaluate performance over a long term period, cyclone Unit 4-7 burned 100% Black Thunder coal (with the customary 3% tire rubber), while the other cyclones, Unit 4-1–Unit 4-6 burned a mixture of 90% Black Thunder and 10% Soshone coal (with the customary 3% tire rubber). During this period of testing, the performance of Unit 4-7 was as good or better than that of the Unit 4-1–Unit 4-6 burning 90% Black Thunder/10% Soshone coal. Typical performance during this period is shown below in Table 2.

TABLE 2

| Unit | Coal Blend (% Black Thunder/ % Soshone) | Secondary Air Temp. (° F.) | Duct Burner Outlet Temp. (° F.) | Performance (Good, OK, Bad) |
|---|---|---|---|---|
| 4-1 | 90/10 | 525 | N/A | OK |
| 4-2 | 90/10 | 580 | N/A | OK |
| 4-3 | 90/10 | 550 | N/A | OK |
| 4-4 | 90/10 | 575 | N/A | OK |
| 4-5 | 90/10 | 560 | N/A | OK |
| 4-6 | 90/10 | 595 | N/A | OK |
| 4-7 | 100/0 | 530 | 750–800 | OK–Good |

Performance was checked visually several times on each shift. If by visual inspection at the cyclone front performance is questionable, coal flow is momentarily interrupted so the barrel of the cyclone can be observed and a firm judgment can be made.

Although vortex burner cyclones were not tested, the same duct burner principle applies. Although scroll burner cyclones were tested by heating the primary air that mixes with the coal, and by heating auxiliary and tertiary air in addition to the primary air, in actual commercial embodiment, I would first add auxiliary air into the scroll burner without additional heating, and then heat auxiliary air as needed, and then subsequently heat primary and/or tertiary air, if necessary to further improve performance.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

I claim:

1. A method of improving the performance of a cyclone furnace having a vortex or radial burner when firing difficult to burn materials having a relatively low heating value or a relatively high moisture content, wherein the furnace has a barrel having a tubular wall with an upstream wall and a downstream wall, the tubular wall, the upstream wall, and the downstream wall defining a combustion chamber, the upstream wall having an inlet that introduces a combined crushed solid fuel and air into the combustion chamber, and the downstream wall having an exhaust outlet that exhausts combusted products; the burner extending outwardly from the upstream wall, away from the barrel, the burner having a cylindrical wall aligned with the upstream wall inlet, and an endwall closing an outer end of the burner cylindrical wall opposite the upstream wall inlet, wherein the burner cylindrical wall has a primary air inlet that introduces, substantially tangentially to the burner cylindrical wall to impart a swirl, primary air that has been preheated to a preheat temperature, which is substantially above an ambient temperature, wherein the barrel tubular wall has a secondary air inlet that introduces, substantially tangentially to the barrel tubular wall to impart a swirl in the barrel, secondary air that also has been preheated to the preheat temperature, wherein the burner has a fuel inlet that introduces the crushed solid fuel, the method comprising:

additionally heating the preheated primary air to a temperature higher than the preheat temperature; and introducing the additionally heated primary air into the primary air inlet, the preheated secondary air into the secondary air inlet, and the crushed solid fuel into the fuel inlet, wherein the additionally heated primary air introduced into the burner causes rapid ignition and thus more nearly complete combustion within the cyclone furnace of the difficult to burn material.

2. A method according to claim 1, wherein the difficult to burn materials include sub-bituminous coals.

3. A method according to claim 1, wherein the primary air entering the primary air inlet is heated to a temperature higher than the preheat temperature using an auxiliary heater, without increasing the temperature of the secondary air entering the secondary air inlet.

4. A method according to claim 1, wherein the primary air entering the primary air inlet is heated to a temperature of at least 50° F. higher than the preheat temperature.

5. A method according to claim 4, wherein the cyclone furnace is adapted to be connected to a boiler having a heat exchanger located downstream of the boiler for heating air, wherein the air heated by the heat exchanger is a preheated air source for the primary and secondary air.

6. A method according to claim 5, wherein the heat exchanger is connected to a windbox that supplies air so that the heat exchanger preheats air using heat from hot gases exhausting from the boiler.

7. A method according to claim 5, wherein the air passing through the heat exchanger is heated to at least about 450° F.

8. A method according to claim 6, wherein the air passing through the heat exchanger is heated to about between 500° to 650° F.

9. A method according to claim 1, wherein the radial burner includes a tertiary air inlet that introduces tertiary air to the burner endwall.

10. A method according to claim 9, wherein the fuel inlet is configured to introduce the crushed solid fuel substantially tangentially to the burner cylindrical wall to impart a swirl in the same direction as the swirl imparted by the primary air.

11. A method according to claim 1, wherein the vortex burner has the fuel inlet located in the burner endwall and configured to introduce the crushed solid fuel substantially axially, with the primary air imparting swirl to the crushed solid fuel.

12. A cyclone furnace according to claim 3, wherein the auxiliary heater heats the preheated primary air to about between 650° to 950° F.

13. A cyclone furnace having one of a radial burner and a vortex burner, which furnace has a barrel having a tubular wall with an upstream wall and a downstream wall, the tubular wall, the upstream wall, and the downstream wall defining a combustion chamber, the upstream wall having an inlet that introduces a combined crushed solid fuel and air into the combustion chamber, and the downstream wall having an exhaust outlet that exhausts combusted products; the burner extending outwardly from the upstream wall, away from the barrel, the burner having a cylindrical wall aligned with the upstream wall inlet, and an endwall closing an outer end of the burner cylindrical wall opposite the upstream wall inlet, wherein the burner cylindrical wall has a primary air inlet that introduces, substantially tangentially to the cylindrical wall to impart a swirl, primary air that has been preheated to a preheat temperature, which is substantially above an ambient temperature, wherein the barrel tubular wall has a secondary air inlet that introduces, substantially tangentially to the tubular wall to impart a swirl in the barrel, secondary air that also has been preheated to the preheat temperature, wherein the burner has a fuel inlet that introduces the crushed solid fuel; a primary air duct that conveys the preheated primary air to the primary air inlet; and a secondary air duct that conveys the preheated secondary air to the secondary air inlet; and a fuel duct that conveys the crushed solid fuel to the fuel inlet, the cyclone furnace further comprising:

an auxiliary heater in a path of the primary air duct for heating the preheated primary air entering the primary air inlet to a temperature higher than the preheat temperature to cause rapid ignition and thus more nearly complete combustion within the cyclone furnace of difficult to burn materials having a relatively low heating value or a relatively high moisture content.

14. A cyclone furnace according to claim 13, wherein the difficult to burn materials include sub-bituminous coals.

15. A cyclone furnace according to claim 13, wherein the auxiliary heater heats the preheated primary air entering the primary air inlet to a temperature higher than the preheat temperature, without increasing the temperature of the preheated secondary air entering the secondary air inlet.

16. A cyclone furnace according to claim 13, wherein the auxiliary heater heats the preheated primary air entering the primary air inlet by at least 50° F. higher than the preheat temperature.

17. A cyclone furnace according to claim 13, wherein the cyclone furnace is adapted to be connected to a boiler unit having a heat exchanger located downstream of the boiler to heat air, wherein the air heated by the heat exchanger is a preheated air source for the primary and secondary air.

18. A cyclone furnace according to claim 17, wherein the heat exchanger is connected to a windbox that supplies air so that the heat exchanger preheats air using heat from hot gases exhausting from the boiler.

19. A cyclone furnace according to claim 18, wherein the air passing through the heat exchanger is heated to at least about 450° F.

20. A cyclone furnace according to claim 19, wherein the air passing through the heat exchanger is heated to about between 500° to 650° F.

21. A cyclone furnace according to claim 13, wherein the auxiliary heater heats the preheated primary air to about between 650° to 950° F.

22. A cyclone furnace according to claim 13, wherein the radial burner includes a tertiary air inlet that introduces tertiary air to the burner end wall.

23. A cyclone furnace according to claim 22, wherein the fuel inlet is configured to introduce the crushed solid fuel substantially tangentially to the burner cylindrical wall to impart a swirl in the same direction as the swirl imparted by the primary air.

24. A cyclone furnace according to claim 13, wherein the vortex burner has the fuel inlet located in the burner endwall and configured to introduce the crushed solid fuel substantially axially, the primary air imparting the swirl to the crushed solid fuel.

25. A vortex or radial cyclone furnace comprising:

a barrel having a tubular wall with an upstream wall and a downstream wall, the tubular wall, the upstream wall, and the downstream wall defining a combustion chamber, the upstream wall having an inlet for introducing a combined crushed solid fuel and air into the combustion chamber, and the downstream wall having an exhaust outlet for exhausting combusted products;

a vortex or radial burner extending outwardly from the upstream wall, away from the barrel, the burner having a cylindrical wall aligned with the upstream wall inlet, and an endwall closing an outer end of the burner cylindrical wall opposite the upstream wall inlet, wherein the burner cylindrical wall has a primary air inlet that introduces, substantially tangentially to the cylindrical wall to impart a swirl, primary air that has been preheated to a preheat temperature, which is substantially above an ambient temperature, wherein the barrel tubular wall has a secondary air inlet that introduces, substantially tangentially to the tubular wall to impart a swirl in the barrel, secondary air that also has been preheated to the preheat temperature, wherein the burner has a fuel inlet that introduces the crushed solid fuel;

a primary air duct that conveys the preheated primary air to the primary air inlet;

a secondary air duct that conveys the preheated secondary air to the secondary air inlet;

a fuel duct that conveys the crushed solid fuel to the third inlet; and an auxiliary heater in a path of the primary air duct for heating the preheated primary air entering the primary air inlet to a temperature higher than the preheat temperature to cause rapid ignition and thus more nearly complete combustion within the cyclone furnace of difficult to burn materials having a relatively low heating value or a relatively high moisture content.

26. A cyclone furnace according to claim 25, wherein the difficult to burn materials include sub-bituminous coals.

27. A cyclone furnace according to claim 26, wherein the auxiliary heater heats the preheated primary air entering the primary air inlet by at least 50° F. higher than the preheat temperature.

28. A cyclone furnace according to claim 25, wherein the radial burner includes a tertiary air inlet that introduces tertiary air to the burner.

29. A cyclone furnace according to claim 28, wherein the radial burner end wall has an opening through which the tertiary air is directed into the burner substantially axially toward the upstream wall inlet.

30. A cyclone furnace according to claim 29, wherein the fuel inlet is configured to introduce the crushed solid fuel tangentially to the burner cylindrical wall to impart a swirl in the same direction as the swirl imparted by the primary air.

31. A cyclone furnace according to claim 25, wherein the vortex burner has the fuel inlet located in the burner endwall and configured to introduce the crushed solid fuel substantially axially, the primary air imparting the swirl to the crushed solid fuel.

32. A cyclone furnace according to claim 25, wherein the auxiliary heater heats the preheated primary air to about between 650° to 950° F.

* * * * *

UNITED STATES PATENT AND TRADEMARK OFFICE

CERTIFICATE OF CORRECTION

PATENT NO. : 6,199,494 B1
DATED : March 13, 2001
INVENTOR(S) : Griffin

It is certified that error appears in the above-identified patent and that said Letters Patent is hereby corrected as shown below:

Title page,
Please include attached references to item [56] --

U.S. PATENT DOCUMENTS

| | | | |
|---|---|---|---|
| 4,408,548 | 10/83 | Schmalfeld, et al. | 110/347 |
| 4,438,707 | 03/84 | Delaplace, et al. | 110/264 |
| 4,206,712 | 06/80 | Vatsky | 110/264 |
| 4,638,747 | 01/87 | Brock, et al. | 110/264 |
| 5,052,312 | 10/91 | Rackley, et al. | 110/346 |
| 4,580,504 | 04/86 | Beardmore, et al. | 110/261 |
| 4,027,603 | 06/77 | Lohner | 110/18 R |
| 4,881,476 | 11/89 | Becker, et al. | 110/347 |
| 5,878,700 | 03/99 | Farzan, et al. | 122/4 D |
| 4,604,052 | 08/86 | Brown, et al. | 431/168 |
| 4,924,784 | 05/90 | Lennon, et al. | 110/261 |
| 4,986,199 | 01/91 | Komeno, et al. | 110/247 |
| 1,946,011 | 02/34 | Burg | 110/28 |
| 3,108,869 | 10/63 | Ellis | 75/41 |
| 2,917,011 | 12/59 | Korner, et al. | 110/28 |

OTHER DOCUMENTS
Steam: Its Generation and Use, 40th ed., Babcock & Wilcox Co., Barberton, Ohio, 1992: Chapter 14, pp. 14-1-14-11, --

Signed and Sealed this

Ninth Day of April, 2002

*Attest:*

*Attesting Officer*

JAMES E. ROGAN
*Director of the United States Patent and Trademark Office*